United States Patent [19]

Fujimura et al.

[11] Patent Number: 4,483,897

[45] Date of Patent: Nov. 20, 1984

[54] NON-WOVEN FABRIC

[75] Inventors: Isao Fujimura; Sadaaki Nakajima; Morio Abe; Masahiko Taniguchi, all of Shigaken, Japan

[73] Assignee: Chisso Corporation, Osaka, Japan

[21] Appl. No.: 602,805

[22] Filed: Apr. 23, 1984

[51] Int. Cl.[3] ..... D04H 1/58

[52] U.S. Cl. ..... 428/288; 428/296; 428/297; 428/340; 428/360; 428/373; 428/374

[58] Field of Search ..... 428/288, 296, 297, 340, 428/360, 373, 374

[56] References Cited

U.S. PATENT DOCUMENTS

| | | | |
|---|---|---|---|
| 3,801,428 | 4/1974 | Striegler et al. | 428/297 |
| 4,265,972 | 5/1981 | Rudner | 428/373 |
| 4,323,626 | 4/1982 | Kunimune et al. | 428/373 |
| 4,373,000 | 2/1983 | Knoke et al. | 428/373 |
| 4,421,813 | 12/1983 | Athey | 428/373 |

*Primary Examiner*—James J. Bell

*Attorney, Agent, or Firm*—Fred Philpitt

[57] ABSTRACT

Non-woven fabrics having light weight, high strength, soft hand and not having any waxy feeling is provided by subjecting fiber admixture to heat treatment, which fiber admixture is composed of foamed fiber, heat adhesive fiber and other kinds of fibers if necessary.

1 Claim, No Drawings

NON-WOVEN FABRIC

BACKGROUND OF THE INVENTION

1. Field of the Invention

The present invention relates to a soft and bulky non-woven fabric having light weight, high strength and excellent hand without waxy feeling.

2. Description of the Prior Art

In the recent increasing consumption of non-woven fabrics, the demand for lower weight non-woven fabrics of 10~50 g/m$^2$, above all from 15 to 35 g/m$^2$, is remarkably arising as for surface liner of disposal sanitary materials. It is required to non-woven fabrics used in this field to have following preferable properties, that are light weight, high strength, bulky, less fluffs, soft hand and to give agreeable feeling to human skin contacting with. The non-woven fabrics made by a binder adhesion process commonly utilized hitherto have such drawbacks that their hand become harder by increasing the quantity of the binder used in request to improve the strength, that the kinds of binders applicable to produce non-woven fabrics for surface liners of disposal diaper or sanitary napkin is strictly limited by the regulation of residual formalin in the non-woven fabrics, and that as the hydrophobic synthetic fibers such as polyolefin fiber and polyester fiber are coming to the main raw materials of non-woven fabrics, the difficulty to keep both of soft hand and high strength of non-woven fabrics made by a binder adhesion process is increasing from the view points of technology and economy.

In the above mentioned background, recently a process for producing non-woven fabrics so called no-binder process, by which structure of the non woven fabrics is stabilized by fixing the comprising fibers by melt adhesion of heat adhesive fiber, is coming before footlight obtaining somewhat good results of low equipment cost and low energy consumption. However, the waxy feeling possessed by hydrophobic fibers in themselves is perceived more apparent when the fibers become more fine ones. So, the unpleasant feeling caused by the waxy feeling is growing to a new problem on such products as sanitary materials which are used contacting with human skin in direct and are main uses of light weight non-woven fabrics.

The present inventors have made streneous studies to obtain a bulky and soft hand non-woven fabric which retains a high strength on light weight and also is provided non-waxy feeling, and have attained this invention by finding that the utilization of both foamed fibers and heat adhesive fibers as raw materials of non-woven fabric solves above-mentioned problems.

SUMMARY OF THE INVENTION

The present invention resides in a non-woven fabric having a weight of 10~50 g/m$^2$, and the structure of said non-woven fabric is stabilized by adhesion of heat adhesive fibers, characterized by the composition consisting of at least 30 wt. % of foamed fibers made of polypropylene or polyester having a single fiber fineness of 0.5~6 deniers, at least 20 wt. % of heat adhesive fibers and balance of other kinds of fibers, wherein the foamed fiber is any of conjugate fiber of sheath-core type or side-by-side type and only sheath component in the case of sheath-core type conjugate fiber or only a component dominantly forming the fiber surface along the direction of fiber axis in the case of side-by-side conjugate fiber substantially contains foamed cells and a part of the foamed cells are bursted out the fiber surface.

DETAILED DESCRIPTION OF THE INVENTION

The foamed fiber used in the present invention is referred to sheath-core type or side-by-side type conjugate fiber made of polypropylene or polyester having a single fiber fineness of 0.5 to 6 deniers, wherein only the sheath component in the case of sheath-core type or a component dominantly forming the fiber surface along the direction of the fiber axis in the case of side-by-side type substantially contains foamed cells and a part of the foamed cells are burst out the fiber surface. If the single fiber fineness exceeds 6 deniers, the hand of the non-woven fabric made of the foamed fiber becomes harder. If the single fiber fineness is less than 0.5 deniers, the feel of the non-woven fabric becomes waxy and further troubles caused by declained processability of the foamed fiber occur in the carding or fiber mixing process.

The content of said foamed fiber in the non-woven fabric of the present invention is in the range of 30~80% by weight. If the content is less than 30%, the improvement in the feel (decrease of wavy feeling) becomes insufficient. If the content of the foamed fiber exceeds 80%, the content of heat adhesive fiber, as mentioned below, becomes less than 20% which causes insufficient strength of the non-woven fabric obtained.

The foamed fiber mentioned above may be obtained by spinning a conjugate fiber of polypropylene or polyester blending a suitable amount of a foaming agent with only a conjugate component dominantly forming the fiber surface along with the fiber axis, as disclosed in the Japanese Patent Application No. Sho-57-151048 (1982).

The structure of non-woven fabric disclosed in this invention is stabilized by fixing the comprising fibers by adhesion with heat adhesive fiber. By binder process, the non-woven fabric is produced by dipping web into a binder solution or spraying a binder solution on web and thereafter evaporating the solvent, so, the surface of the foamed fiber is coated with the binder and thus agreeable feeling characteristic of foamed fibers cannot be shown off. On the contrary, by heat adhesive fiber process the adhesion of the fibers is carried out at the contact points of the fibers comprising the non-woven fabric such as the foamed fiber and the heat adhesive fiber, so, the foamed fiber is converted to a non-woven fabric maintaining its original characteristic feeling.

Both types of the heat adhesive fibers, single component heat adhesive fiber consisting of fiber-formable thermoplastics such as polypropylene, polyethylene, polyester, polyamide, etc. and conjugate heat adhesive fiber consisting of multiple components having different melting points each other, are well known. As for the single component heat adhesive fibers, the fibers made of polypropylene, polyethylene or low melting point polyester are preferably utilized because of easiness of heat adhesion based on their low melting points. The conjugate heat adhesive fibers are more preferably utilized than the single component heat adhesive fibers by following reasons. In the case of conjugate fiber, low melting point component can obtain the fibrous form supported by high melting point component, therefor, the material having a lower melting point than the melting points of materials utilized in single component heat adhesive fibers is applicable as the heat adhesive component thereof, and said conjugate heat adhesive fiber gives more bulky and more soft non-woven fabric than single component heat adhesive fiber, because at the heat treatment procedure only the low melting point component is fused remaining the high melting point component in the fibrous form which results less shrinkage of the web. As for the said conjugate heat adhesive fiber, Japanese Patent Publications No. Sho 55-17807 and Sho 55-26209 disclose conjugate fibers consisting of polypropylene as high melting point component and polyethylene, ethylene-vinyl acetate copolymer or saponified product of said copolymer as low melting point component.

The content of said heat adhesive fiber in the non-woven fabric of the present invention is in the range of 20~70% by weight. If the content of heat adhesive fiber is lower than 20%, resulted non-woven fabric is inferior in strength and has many fluffs on its surface. If the content of heat adhesive fiber exceeds 70%, the content of foamed fiber cannot attain 30% and resulted non-woven fabric shows waxy feeling.

In addition, any of the heat adhesive fibers composed of one kind of heat adhesive fiber or composed of two or more kinds of heat adhesive fibers can be utilized in the present invention. As a matter of course, the melting point of heat adhesive component of the heat adhesive fiber should be lower than, preferably lower 20° C. or more than, the melting point of foamed component of the foamed fiber.

The non-woven fabric of the present invention can also be composed of other kinds of fibers than the foamed fiber and the heat adhesive fiber under the condition that the content of the foamed fiber exceeds 30% and the content of the heat adhesive fiber exceeds 20%. As for above mentioned other kinds of fiber, any of the fiber which does not melt or deteriolate by the heat treatment in the procedure of non-woven fabric production is useful and natural fibers made of cotton, linen and wool, etc., semi-synthetic fibers made of rayon, cellulose acetate, etc., as well as synthetic fibers made of polyester, polyamide, etc. are shown as example.

The foamed fiber, the heat adhesive fiber and the other kinds of fibers mentioned above are joined and admixed homogeneously by means of an ordinary carding machine, a random webber or a dry pulp process to obtain a web of specified weight. The said web is then converted into a non-woven fabric by being subjected to the heat treatment at a temperature between the melting point of the heat adhesive component of the heat adhesive fiber and the melting point of the foamed component of the foamed fiber. The said heat treatment is carried out by any heating means of dry heating or wet heating such as a hot calender rolls, a suction dryer, a Yankee dryer, etc.

The non-woven fabric of the present invention thus obtained has no waxy feeling which is experienced on the non-woven fabrics made of ordinary polypropylene fiber or polyester fiber bonded with heat adhesive fiber, and give us a dry and agreeable feeling when touched directly to skin. So, the non-woven fabric of the present invention is preferably utilized as surface liners of disposal diapar, sanitary napkin, cosmetic puff, etc.

Further, the non-woven fabric of the present invention has characteristics of markedly improved strength and suppressed fluffiness given by the wedge-effect caused by entering the molten heat adhesive component of the heat adhesive fiber into cavities opened on the surface of the foamed fiber. The said characteristics are profitable for thin and light weight non-woven fabrics.

Furthermore, the non-woven fabric of the present invention has characteristics of improved whiteness and favorable transrucent impression given by optical effect of foamed cells in the foamed fiber without applying any brightner, and also has characteristic of improved bulky feeling accompanied with increased flexural modulus.

The present invention will be further illustrated concretely by way of Examples and Comparative examples. In addition, methods for measuring properties of non-woven fabrics referred to therein are shown below.

Strength of non-woven fabric:

According to JIS L1096, a sample piece of 5 cm wide was measured at an initial distance between grips, of 10 cm and at a rate of stretching per minute of 100%.

Feeling of non-woven fabric:

Evaluation was made by functional tests.

: case where the fabric is judged not to be waxy.

: case where the fabric is judged to be indistinctly waxy.

Δ: case where the fabric is judged to be distinctly waxy.

X: case where the fabric is judged to be strongly waxy.

Fluff:

Evaluation was made by observation with naked-eye after rubbing the surface of the fabric with finger.

: case where no fluff was observed.

: case where scarecely any fluff was observed.

Δ: case where fluff was apparently observed.

X: case where fluff was conspicurously observed.

Examples 1~5, and Comparative examples 1~3

Webs having a weight of about 20 g/m$^2$ were prepared by feeding a carding machine various kinds of admixture of fibers as shown in Table 1. Any of the resulting webs were converted to non-woven fabrics by heat treating with a suction drum dryer maintained at 145° C.

The characteristic properties of the non-woven fabrics obtained in Examples and Comparative examples are also shown in Table 1.

TABLE 1

| | Composition of fiber admixture (wt. %) | | | Properties of non-woven fabric | | | |
|---|---|---|---|---|---|---|---|
| | Foamed fiber | Heat adhesive fiber | Other fiber | Weight (g/m$^2$) | Strength (g/5cm) | Feeling | Fluff |
| Ex. 1 | PP-S/c, 3d, 70% | PP/PE-S/S, 3d, 30% | — | 21 | 540/470 | | |
| Ex. 2 | PP-S/c, 3d, 35% | PP/PE-S/S, 3d, 65% | — | 18 | 740/610 | | |
| Comp. ex. 1 | PP-S/c, 3d, 25% | PP/PE-S/S, 3d, 75% | — | 20 | 860/620 | | x |
| Ex. 3 | PP-S/S, 3d, 70% | PP/PE-S/S, 3d, 30% | — | 19 | 450/400 | | |
| Ex. 4 | PP-S/c, 3d, 40% | PP/PE-S/S, 3d, 40% | PP, 3d, 20% | 19 | 560/480 | | |
| Comp. ex. 2 | — | PP/PE-S/S, 3d, 40% | PP, 3d, 60% | 21 | 210/170 | x | x |
| Ex. 5 | PET-S/c, 3d, 5% | PP/PE-S/S, 3d, 50% | — | 20 | 600/440 | | |
| Comp. | — | PP/PE-S/S, 3d, 50% | PET, 3d, 50% | 22 | 320/220 | x | x |

TABLE 1-continued

| | Composition of fiber admixture (wt. %) | | | Properties of non-woven fabric | | | |
|---|---|---|---|---|---|---|---|
| | Foamed fiber | Heat adhesive fiber | Other fiber | Weight ($g/m^2$) | Strength (g/5cm) | Feeling | Fluff |
| ex. 3 | | | | | | | |

wherein:
PP (polypropylene), PE (polyethylene), PET (polyester) S/c (sheath-core type), S/S (side-by-side type), d (denier), Strength (machine direction/traverse direction)

As is apparent from Table 1, any of the non-woven fabrics obtained based on the constitution of the present invention had improved strength, agreeable feeling and reduced fluff.

What is claimed is:

1. A non-woven fabric having a weight of 10~50 $g/m^2$, and the structure of said non-woven fabric is stabilized by adhesion of heat adhesive fibers, characterized by the composition consisting of at least 30 wt. % of foamed fibers made of polypropylene or polyester having a single fiber fineness of 0.5~6 deniers, at least 20 wt. % of heat adhesive fibers and balance of other kinds of fibers, wherein the foamed fiber is any of conjugate fiber of sheath-core type or side-by-side type and only sheath component in the case of sheath-core type conjugate fiber or only a component dominantly forming the fiber surface along the direction of fiber axis in the case of side-by-side conjugate fiber substantially contains foamed cells and a part of the foamed cells are bursted out the fiber surface.

* * * * *